United States Patent [19]

Saito

[11] 4,147,351

[45] Apr. 3, 1979

[54] CRASH VAN CHASE

[75] Inventor: Makoto Saito, Tokyo, Japan

[73] Assignee: Tomy Kogyo Co., Inc., Tokyo, Japan

[21] Appl. No.: 867,329

[22] Filed: Jan. 5, 1978

[30] Foreign Application Priority Data

Jan. 20, 1977 [JP] Japan ..... 52-5958[U]

[51] Int. Cl.[2] ..... A63F 9/14; A63H 17/02

[52] U.S. Cl. ..... 273/86 B; 46/202; 46/211; 46/259

[58] Field of Search ..... 273/86 R, 86 B; 46/1 K, 46/201, 202, 211, 258, 259, 260, 261

[56] References Cited

U.S. PATENT DOCUMENTS

| | | | |
|---|---|---|---|
| 3,000,137 | 9/1961 | Vine | 46/211 |
| 3,860,237 | 1/1975 | Cooper et al. | 273/86 R |
| 3,892,086 | 7/1975 | Gay et al. | 46/202 |
| 3,948,520 | 4/1976 | Barlow | 273/86 F |
| 3,970,309 | 7/1976 | Sato | 273/86 B |

FOREIGN PATENT DOCUMENTS

| | | | |
|---|---|---|---|
| 388974 | 6/1908 | France | 46/201 |

*Primary Examiner*—Anton O. Oechsle
*Attorney, Agent, or Firm*—Staas & Halsey

[57] ABSTRACT

A racing game consisting of powered vehicles, a continuous trackway having substantially separate first and second guide mechanisms for directing the vehicles along the trackway, the vehicles being permitted to travel faster along the first guide mechanism than along the second guide mechanism, a switching station normally diverting the vehicles from the first guide mechanism to the second guide mechanism and retaining the vehicles in the second guide mechanism, a control assembly operative to actuate the switching mechanism to divert the vehicles from the second guide mechanism to the first guide mechanism and to retain the vehicles in the first guide mechanism, the vehicle being provided with a mechanism causing same to leave the trackway when moving along the second guide mechanism when struck by another of the vehicles moving along the first guide mechanism.

6 Claims, 13 Drawing Figures

CRASH VAN CHASE

BACKGROUND AND SUMMARY OF THE INVENTION

The present invention falls within the general class of racetrack amusement devices wherein each player is assigned a racing vehicle and is capable of maneuvering to a limited extent the speed and path of travel of the vehicle. More particularly, the present invention includes a control section wherein each player attempts to direct his vehicle along the faster of two guiding channels, and mechanism within the vehicles for causing same to somersault off of the trackway where a vehicle moving along the faster of the channels crashes into the rear of a vehicle moving along the slower of the channels.

DESCRIPTION OF THE PREFERRED EMBODIMENT

Figure 1:
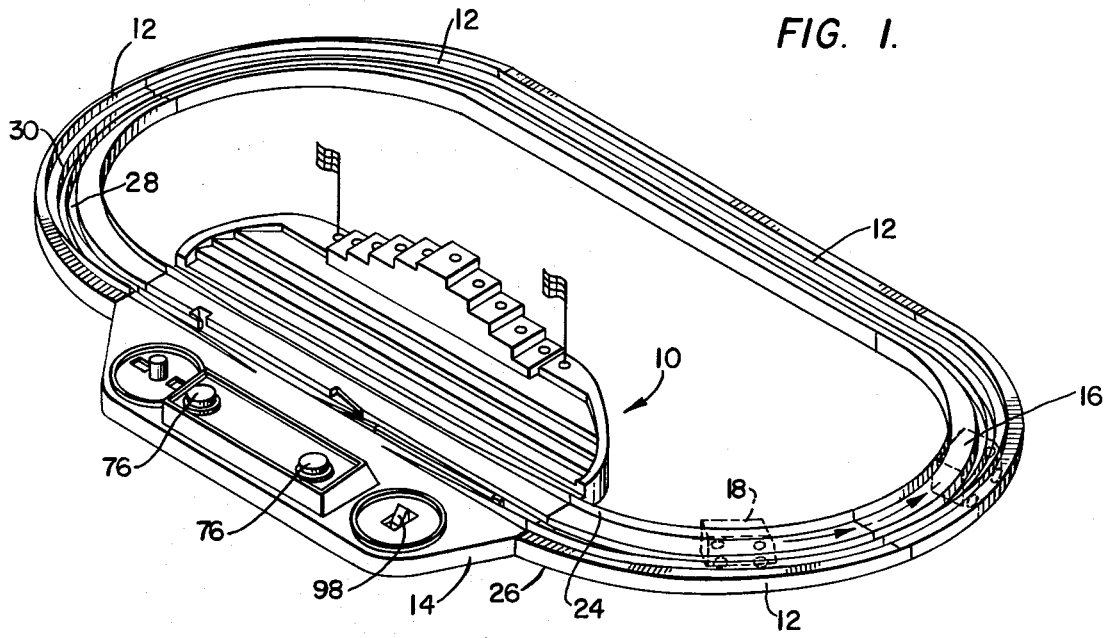
FIG. 1 is a perspective view of the present invention, illustrating the control section through which the buttons for actuating the movable rail and for starting the game protrude, the assembled sections defining the continuous trackway which are provided with guiding channels and the two powered vehicles.
Figure 3:
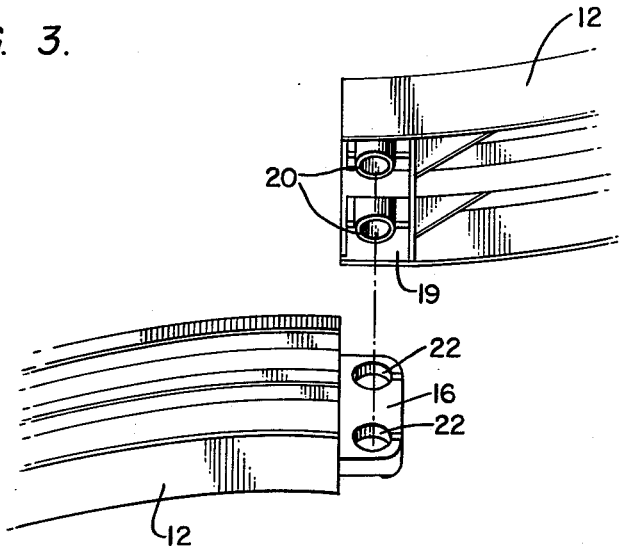
FIG. 3 is a perspective view of the ends of adjacent trackway sections, illustrating the construction of the locking flanges permitting the sections to be assembled to define the continuous trackway.

The amusement device of the present invention, as illustrated in FIG. 1, consists of a continuous trackway designated by the reference numeral 10 comprised of a plurality of sections 12 and a control section 14 which are joined together, and a plurality of powered vehicles 16 and 18. As illustrated in FIG. 3, the ends of adjacent of the sections 12 and 14 are provided with locking flanges 16 and 19 permitting the sections 12 and 14 to be assembled by pressing the depending cylindrical members 20 within the openings 22.

Each of the sections 12 of the trackway is provided with upstanding rails 24 and 26, and channels 28 and 30 within which the guiding flanges 32 of the vehicles 16 and 18 are positioned so as to guide the vehicles 16 and 18 along the trackway 10.

Figure 2:
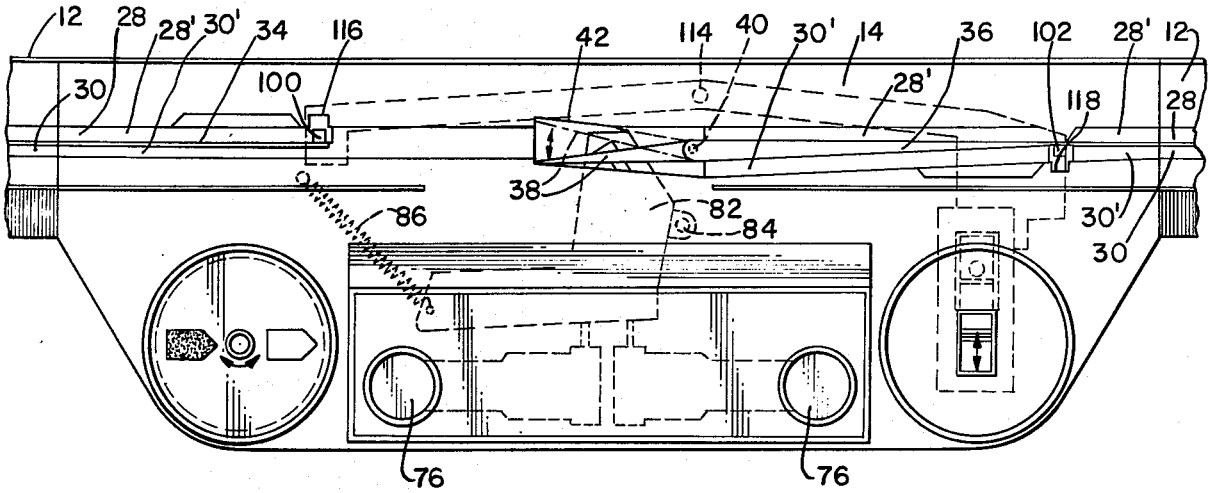
FIG. 2 is a top plan view of the control section illustrating certain of the operating components for changing the position of the movable rail for directing the vehicles into the faster of the guiding channels and for moving the abutments from the channels to permit the game to be started.

It will be apparent from FIG. 2 that the control section 14 is provided at the lefthand side thereof with a rail 34 and guide channels 28' and 30' on each side thereof which are contiguous with the channels 28 and 30 of the adjacent section 12, and in similar manner on the righthand side thereof with a rail 36, and guide channels 28' and 30' on each side thereof which are contiguous with the guide channels 28 and 30. A movable rail 38 is mounted to the end of the rail 36 with a pin 40 for movement within the cavity 42 to direct the vehicles 16 and 18, as described hereinafter.

Figure 4:
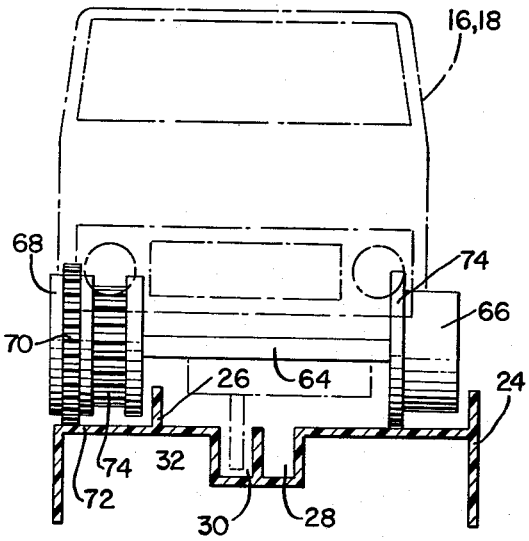
FIG. 4 is a front elevational view of a portion of one of the vehicles, illustrating the construction of the driving wheels and the engagement of the larger gear wheel against the trackway when the vehicle's guiding flange is travelling within the outside channel.
Figure 5:
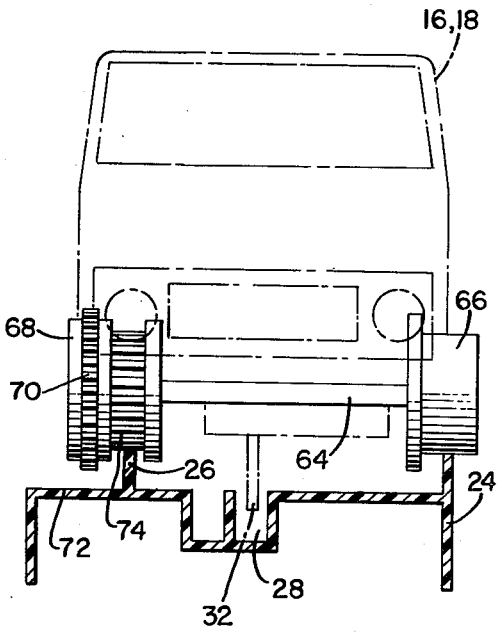
FIG. 5 is a front elevational view of a portion of the vehicle, illustrating the engagement of the smaller gear wheel against the rail extending upwardly from the trackway when the vehicle's guiding flange is travelling within the inside channel.
Figure 9:
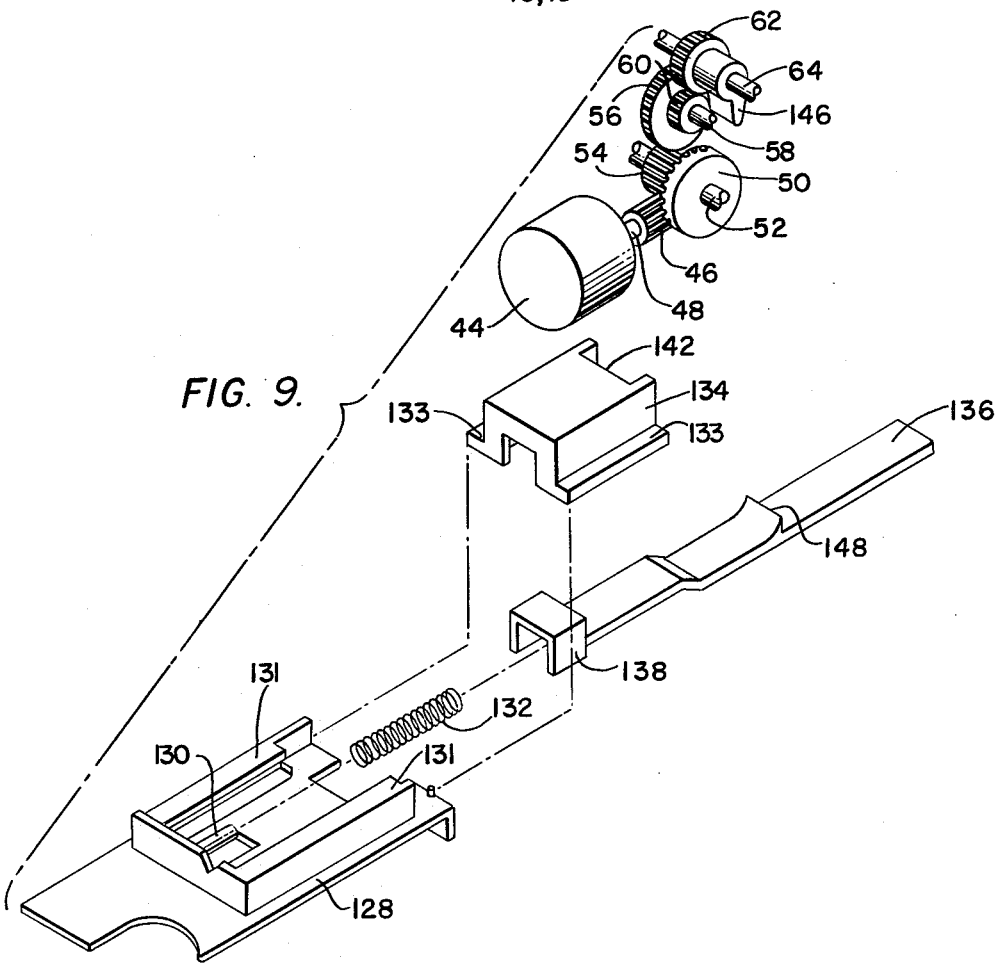
FIG. 9 is an exploded perspective view illustrating the components of the reciprocally mounted actuating rod assembly and their relationship to the abutment formed on the rod and the continuously rotating cam element on the driving axle of the vehicle.

As illustrated in FIG. 9, each of the vehicles 16 and 18 is provided with a conventional miniature electric motor 44 powered by a source of electrical energy. When the motor 44 is energized the spur gear 46 at the end of the shaft 48 meshes with and drives the crown gear 50 causing the shaft 52 journalled within the chassis of the vehicle to rotate. Fixed to the shaft 52 is a gear wheel 54 which meshes with the gear 56 mounted on the shaft 58 which is also journalled within the chassis. The gear 60 of the shaft 58 meshes with the gear 62 which is secured to the axle 64 to which the wheels 66 and 68 are attached. With reference to FIGS. 4–5, it will be apparent that when guiding flange 32 of the vehicles 16 and 18 is within the channel 30, the tread 70 along the periphery of the wheel 68 meshes with and advances along a similar tread formed on the surface 72 of each of the sections 12 while the rim 74 of the wheel 66 engages the top surface of the sections 12. When the guiding flange 32 is within the channel 28, the tread 74 formed along another portion of the wheel 68 that is smaller in diameter and circumference than the tread 70, engages the top of the rail 26 while the wheel 66 engages the top of the rail 24. Since the axle 64 rotates at constant speed, and the diameter of the tread 70 is greater than that of the tread 74, it will be apparent that the vehicles 16 and 18 move faster when the flanges 32 are within the guide channels 30 (FIG. 4) than when the flanges 32 are within the guide channel 28 (FIG. 5).

Figure 6:
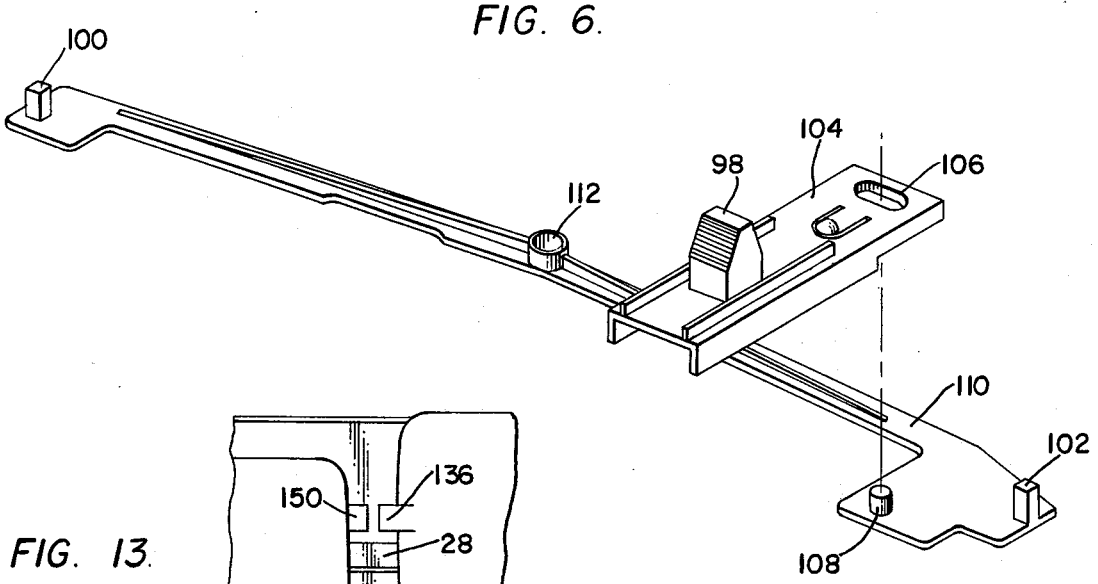
FIG. 6 is a perspective view of the operating mechanism within the control section for removing the abutments positioned within the guiding channels when the game is to be started.
Figure 7:
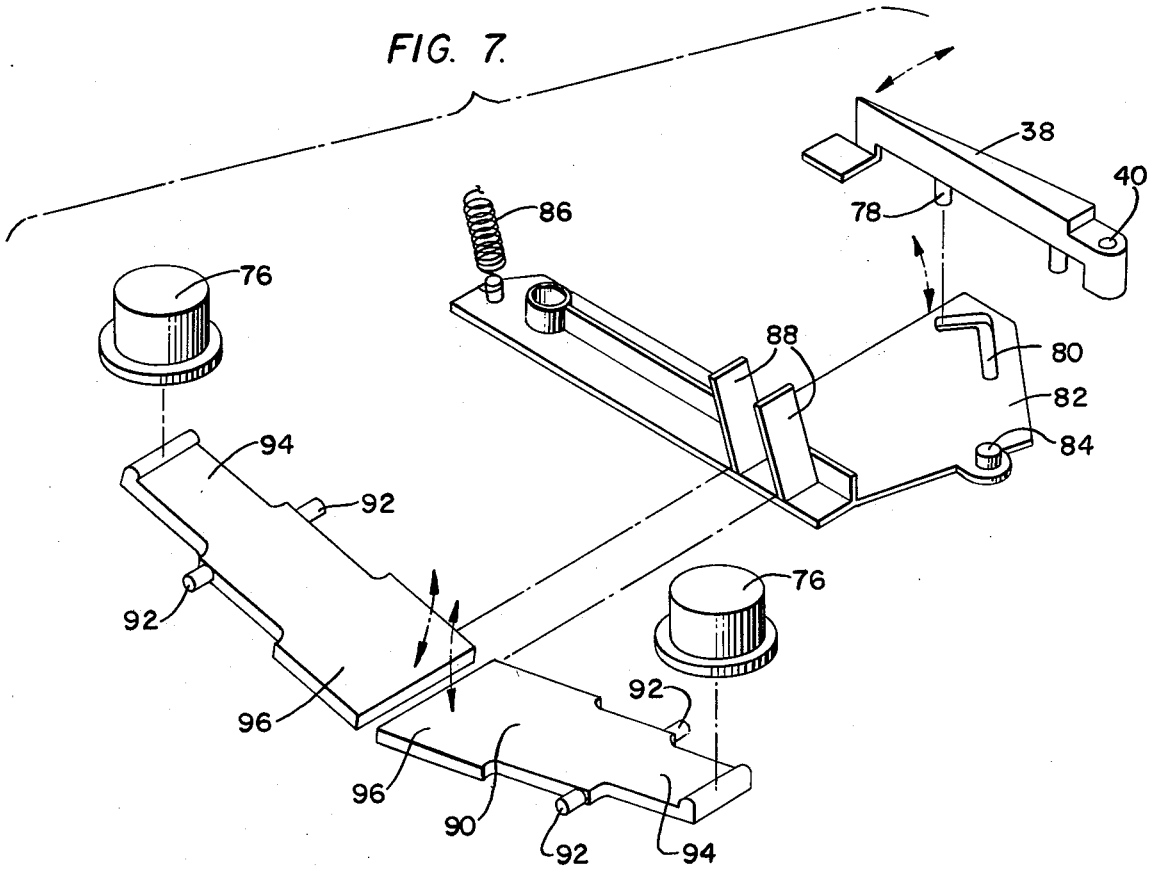
FIG. 7 is an exploded perspective view of the operating mechanism within the control section for changing the position of the movable rail to cause the vehicles to enter the outside guiding channel to achieve greater speed in response to either of the operating buttons being depressed.

The mechanism for operating the movable rail 38 is illustrated in FIGS. 2, 6 and 7. As will be described hereinafter, the movable rail 38 is normally held in the position illustrated in solid lines in FIG. 2 so as to direct the vehicles into the guide channel 28' to propel the vehicles at their slower speed. By depressing the buttons 76, which extend upwardly through section 14, the rail 38 is rotated upwardly about pin 40 to the position shown in dotted lines in FIG. 2, such that the guiding flanges 32 of the vehicles will be directed into the channel 30'. As seen in FIG. 7, the movable rail 38 is provided with a post 78 which is positioned within a slot 80 within the plate 82 which is provided with a post 84 mounted for rotation to the section 14. The spring 86, which is secured at one end to the plate 82 and at the other end to the casing of the section 14, normally urges the plate 82 to rotate about an axis corresponding to the post 84 such that the slot 80 adjusts the position of the post 78 and the movable rail 38, as illustrated in solid lines in FIG. 2. Extending outwardly from the plate 82 are a pair of arms 88. Located immediately below the buttons 76 are levers 90 having posts 92 which are journalled for rotation to the casing of the section 14, such that as the buttons 76 are depressed the bottoms thereof engage the ends 94 of the levers 90 causing the other ends 96 of the levers 90 to move upwardly eventually engaging the arms 88 of the plate 82 causing the plate 82 to rotate against the force of the spring 86 causing the slot 80 of the plate 82 to change the position of the post 78 moving the rail 38 to the position illustrated in dotted lines in FIG. 2. From the foregoing, it will be apparent that each of the players may depress his button 76 when the vehicles 16 and 18 enter the control section 14 for the purpose of positioning the movable rail 38 to guide the flanges 32 of the vehicles into the guide channel 30' to achieve the greater of the two possible speeds along the trackway 10.

The control section 14 is also provided with a button 98 which moves abutments 100 and 102, illustrated in FIG. 2, in and out of guide channels 28' and 30', respectively. From FIGS. 2 and 6, it will be apparent that button 98 extends upwardly from a plate 104 which is slidably mounted within the casing of section 14. The plate 104 is provided with an opening 106 through which a post 108, which extends upwardly from a lever 110, passes. The lever 110 is provided with an opening 112 through which a post 114 formed as a part of the chassis extends, thus permitting the lever 110 to rotate about the post 114 as the button 98 is moved. The abutments 100 and 102 are formed as an integral part of the lever 110 and as seen in FIG. 6 extend upwardly from the ends therefrom. From the foregoing, it will be apparent that when the button 98 is moved forwardly to the position illustrated in FIG. 2, the abutments 100 and 102 are moved into blocking position within the guiding channels 28' and 30', respectively, thus preventing movement of the vehicles 16 and 18 through the section 14. In this manner, it is possible to activate the motors of the vehicles 16 and 18 and to position the vehicles in their "starting" positions at abutments 100 and 102, and thereafter move the button 98 rearwardly removing the abutments 100 and 102 from the channels 28' and 30' into the cavities 116 and 118 permitting the vehicles 16 and 18 to move forward.

Figure 8:
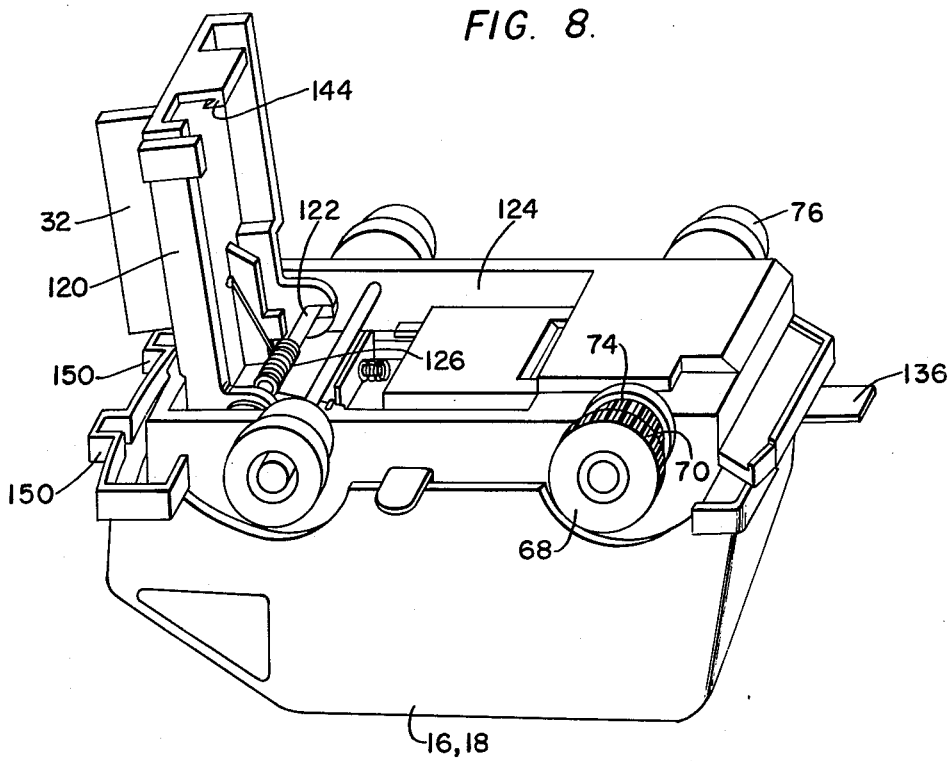
FIG. 8 is a perspective view of one of the vehicles, illustrating the movable plate, to which the guiding flange is attached, urged to its open position by the influence of a spring, so as to cause the vehicle to somersault off of the trackway in response to another of the vehicles crashing into the rear thereof.
Figure 10:
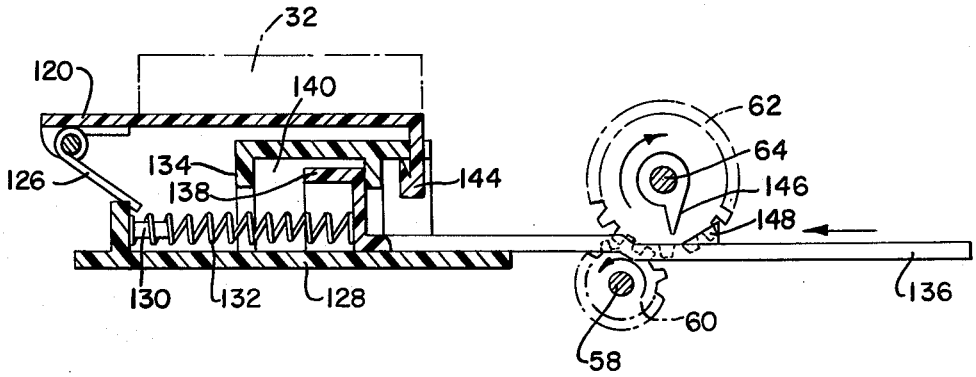
FIG. 10 is a sectional view of a portion of the vehicle, illustrating in particular the position of the actuating rod which extends rearwardly of the vehicle before it is engaged by the front of the other vehicle.
Figure 11:
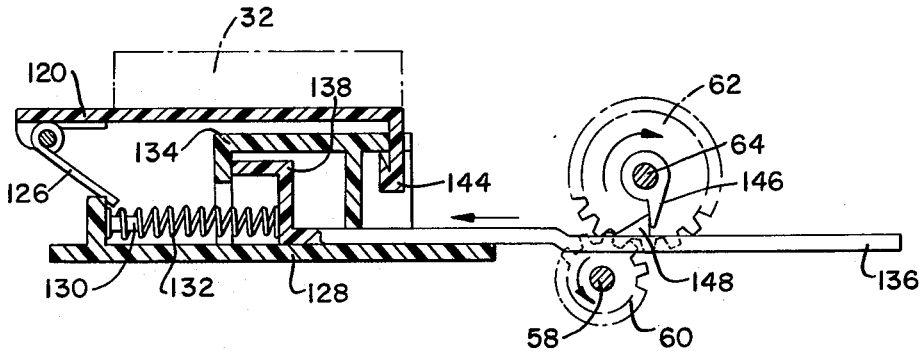
FIG. 11 is a sectional view illustrating the rod being moved forwardly when engaged by the front of the faster moving vehicle, at which time the continuously rotating cam element engages the abutment extending upwardly from the rod.
Figure 12:
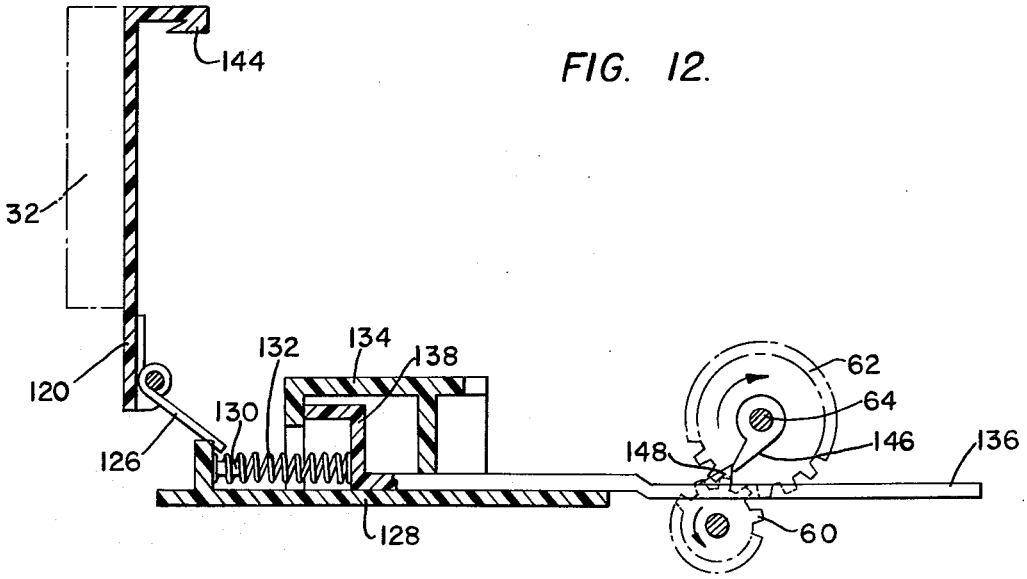
FIG. 12 is a sectional view illustrating the abrupt forward movement of the actuating rod caused by the force of the rotating cam element against the abutment of the rod, and the resulting release of the plate to which the guiding flange is attached which is responsible for causing the vehicle to somersault off to the trackway.

From FIG. 8, it will be apparent that the flanges 32 of the vehicles 16 and 18 are attached to a plate 120 which is mounted to rotate about a shaft 122 journalled within the walls of the chassis 124. A spring 126 is coiled around the shaft 122 and has one end thereof resting against the plate 120 and the other end resting against the chassis 124, thus normally urging the plate 120 to rotate in a counterclockwise direction. The chassis 124, as seen in FIG. 9, is provided with a rigid plate 128 having a post 130 about which one end of a coil spring 132 is positioned. The plate 128 includes shoulders 131 which accommodate the flanges 133 of the housing 134, thus permitting the housing 134 to slide relative to the plate 128. The rod 136 is provided at one end with a housing 138 into which the other end of the spring 132 is positioned, and it will be apparent that the housing 138 fits within a cavity 140 (FIG. 10) within the housing 134. The assembled components are illustrated in FIGS. 10–12 wherein it will be apparent that the spring 132 normally urges the housings 134 and 138 and the rod 136 outwardly. The housing 134 is also provided with a recessed surface 142 accommodating the latching member 144 of the plate 120, permitting the plate 120 to be rotated against the force of the spring 126 until the latching member 144 is secured by the recessed surface 142 of the housing 144. When the rod 136 is moved inwardly against the force of the spring 132, the housing 134 is moved inwardly causing the latching member 144 to be released, thus permitting the plate 120 to rotate to its open position, as illustrated in FIG. 8.

Operation of the rod 136 to release the plate 120 is illustrated in FIGS. 10–12, but initially attention is directed to FIG. 9 wherein it will be apparent that the axle 64 to which the gear 62 is attached is provided with a cam element 146, while the rod 136 is provided with an upstanding abutment 148 which normally is positioned to the right of the cam element 146. As the rod 136 is moved to the left, as illustrated in FIG. 11, the abutment 148 is eventually positioned to be engaged by the rotating cam element 146. The cam element 146 thus abruptly strikes the abutment 148 forcefully urging the rod 136 further to the left against the force of the spring 132, as illustrated in FIG. 12, thus freeing the latching element 144 from the recessed surface 142 of the housing 134 causing the plate 120 to abruptly rotate to the open position under the influence of the spring 126. It will be apparent that when the plate 120 abruptly rotates to its open position, the vehicles 16 and 18 are caused to somersault forwardly leaving the trackway 10 signalling that the game is over.

Figure 13:
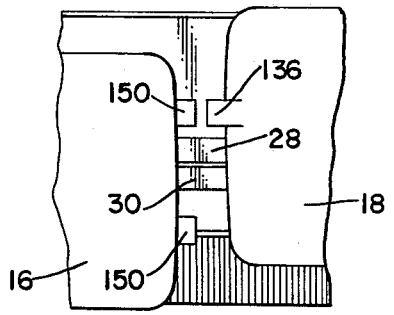
FIG. 13 is a top plan view of portions of adjacent vehicles, illustrating the relationship between the front striking members of the faster vehicle that is travelling in the outer guide channel and the actuating rod extending from the rear of the slower vehicle that is travelling in the inside guiding channel.

As illustrated in FIGS. 8 and 13, the front of each of the vehicles 16 and 18 is provided with two striking members 150. From FIG. 13, it will be apparent that when the flange 32 of the vehicle 16 is within the guiding channel 30, and the flange 32 of the other vehicle 18 is within the guiding channel 28, and the vehicle 16 is thus moving more rapidly than the vehicle 18, one of the striking members 150 is aligned with the rear end of the reciprocally mounted rod 136, such that as the vehicle 16 overtakes the vehicle 18 the striking member 150 engages the end of the rod 136 moving same inwardly, until the rotating cam element 146 strikes the abutment 148 abruptly urging the rod 136 still further forward permitting the plate 120 to open causing the vehicle 18 to somersault off of the trackway 10 signalling that the vehicle 16 is the "winner". It will also be apparent from FIG. 13 that when the flanges 32 of both of the vehicles 16 and 18 are travelling along the same guiding channel, either channel 28 or 30, the striking members 150 are offset from the end of the rod 136, thus preventing the striking members 150 from engaging the rod 136 and activating the rotating plate 120. Thus, the catipulting of a vehicle from the trackway 10 can only occur when one of the vehicles is travelling along the outside, faster path and the other vehicle is travelling along the inside, slower path.

The game is initiated by the players positioning their respective vehicles 16 and 18 behind the abutments 100 and 102. The motors of the vehicles 16 and 18 are started, and the button 98 is moved rearwardly removing the abutments 100 and 102. The movable rail 38 normally diverts the vehicles from the faster guiding channel 30' to the slower guiding channel 28', while directing vehicles that are already in the slower guiding channel 28' to continue along the slower guiding channel 28'. As the vehicles approach the control section 14, the players depress the buttons 76 moving the rail 38 forwardly for the purpose of attempting to gain access to the faster guiding channel 30'. The race continues until one of the vehicles is in the faster guiding channel 30 and the other vehicle is in the slower channel 28, and the faster of the vehicles overtakes the slower of the vehicles, at which time the appropriate striking member 150 engages the rod 136 causing the slower of the vehicles to be catapulted off of the trackway signalling the end of the game. Derailment does not occur when both vehicles are moving either along the slower channels of the faster channels.

What is claimed is:

1. A game, comprising powered vehicles, a continuous trackway having substantially separate first and second guide means for directing said vehicles along said trackway including channels within said trackway, means permitting said vehicles to travel faster along said first guide means than along said second guide means, switching means normally diverting said vehicles from said first guide means to said second guide means and retaining said vehicles in said second guide means, control means operative to actuate said switching means to divert said vehicles from said second guide means to said first guide means and to retain said vehicles in said first guide means, and means causing said vehicles to leave said trackway when moving along said second guide means when struck by another of said vehicles moving along said first guide means including a plate rotatably mounted to a portion of said vehicles normally adjacent said trackway and including a flange extending into said channels to guide said vehicles along said trackway, spring means urging said plate to rotate away from said vehicles, latching means normally holding said plate against said vehicles, and actuating means for releasing said plate when engaged by another of said vehicles.

2. A game as in claim 1, wherein said actuating means comprises a rod mounted to said vehicles for reciprocating movement, spring means urging said rod in one direction to activate said latching means at which time the end of said rod extends beyond said vehicles such that when said rod is engaged by another of said vehicles it is moved against the force of said spring means in the opposite direction deactivating said latching means.

3. A game as in claim 2, wherein said powered vehicles each comprise a shaft, means for rotating said shaft, and a first abutment on said shaft, and wherein said rod is provided with a second abutment positioned between said end of said rod and said first abutment when said rod is in said one position, such that when said rod is engaged by another of said vehicles said second abutment is moved to the vicinity of said first abutment and eventually struck by said first abutment forcefully urging said rod in said opposite direction.

4. A game as in claim 1, wherein said means permitting said vehicles to travel faster along said first guide means than along said second guide means comprises rails extending upwardly from said trackway, and wherein said powered vehicles each comprise a motor, axle, and means operatively connecting said motor and axle, and wherein said axle is provided with first and second wheels having first surfaces engaging the tops of said rails when said vehicles are traveling along said second guide means, and second surfaces of greater diameter than said first surfaces engaging said trackway when said vehicles are traveling along said first guide means.

5. In a racing game having a continuous trackway along which a plurality of powered vehicles race at different speeds, the improvement comprising each of said vehicles being provided with a plate mounted for movement with respect to a portion of said vehicle normally adjacent said trackway, means urging said plate to move away from said vehicle, latching means normally holding said plate against said vehicle, and actuating means for releasing said plate when engaged by another of said vehicles to cause said plate to move downwardly against said trackway propelling said vehicles off said trackway including a rod mounted to said vehicle for reciprocating movement, spring means urging said rod in one direction to activate said latching means at which time the end of said rod extends beyond said vehicle such that when said rod is engaged by another of said vehicles said rod is moved against the force of said spring means in the opposite direction deactivating said latching means, and wherein each of said powered vehicles includes a shaft, means for rotating said shaft, and a striking element provided on said shaft, and wherein said rod is provided with an abutment between said end of said rod and said striking element when said rod is in said one position, such that when said rod is engaged by another of said vehicles, said abutment is moved to the vicinity of said striking element and eventually engaged by said striking element forcefully urging said rod in said opposite direction.

6. A game, comprising powered vehicles, a continuous trackway having substantially separate first and second guide means for directing said vehicles along said trackway, means permitting said vehicles to travel faster along said first guide means than along said second guide means, switching means normally diverting said vehicles from said first guide means to said guide means and retaining said vehicles in said second guide means, control means operative to actuate said switching means to divert said vehicles from said second guide means to said first guide means and to retain said vehicles in said first guide means, means causing said vehicles to leave said trackway when moving along said second guide means when struck by another of said vehicles moving along said first guide means including a plate rotatably mounted to a portion of said vehicles normally adjacent said trackway, spring means urging said plate to rotate away from said vehicles, latching means normally holding said plate against said vehicles, and actuating means for releasing said plate when engaged by another of said vehicles including a rod mounted to said vehicles for reciprocating movement, spring means urging said rod in one direction to activate said latching means at which time the end of said rod extends beyond said vehicles such that when said rod is engaged by another of said vehicles it is moved against the force of said spring means in the opposite direction deactivating said latching means, and wherein said powered vehicles each comprise a shaft, means for rotating said shaft, and a first abutment on said shaft, and wherein said rod is provided with a second abutment positioned between said end of said rod and said first abutment when said rod is in said one position, such that when said rod is engaged by another of said vehicles said second abutment is moved to the vicinity of said first abutment and eventually struck by said first abutment forcefully urging said rod in said opposite direction.

* * * * *